United States Patent [19]

Deussner

[11] 4,209,296

[45] Jun. 24, 1980

[54] APPARATUS AND METHOD FOR THE THERMAL TREATMENT OF FINE GRAINED MATERIAL

[75] Inventor: Herbert Deussner, Bergisch Gladbach, Fed. Rep. of Germany

[73] Assignee: Klöckner-Humboldt-Deutz AG, Fed. Rep. of Germany

[21] Appl. No.: 944,362

[22] Filed: Sep. 21, 1978

[30] Foreign Application Priority Data

Sep. 30, 1977 [DE] Fed. Rep. of Germany ..... 2744042

[51] Int. Cl.[2] ..... F27B 7/02

[52] U.S. Cl. ..... 432/14; 106/100; 432/106

[58] Field of Search ..... 106/100; 432/14, 15, 432/106

[56] References Cited

U.S. PATENT DOCUMENTS

| | | | |
|---|---|---|---|
| 3,834,860 | 9/1974 | Fukuda et al. | 432/15 |
| 3,869,248 | 3/1975 | Hirai et al. | 432/14 |
| 3,938,949 | 2/1976 | Christiansen | 432/14 |
| 3,986,818 | 10/1976 | Deussner et al. | 432/106 |
| 4,004,876 | 1/1977 | Sylvest | 432/14 |
| 4,127,406 | 11/1978 | Kreft et al. | 432/14 |

*Primary Examiner*—John J. Camby

*Attorney, Agent, or Firm*—Hill, Van Santen, Steadman, Chiara & Simpson

[57] ABSTRACT

An apparatus and method for the treatment of fine grained materials including a calcining furnace, a plurality of cyclone separators arranged in series, with exhaust means delivering exhaust gases from the calcining furnace to one of the cyclone separators, with at least the first two of the plurality of cyclone separators being at substantially the same vertical height. Supplemental combustion means consisting of a fuel injection means and a combustion air injection means are included in the path of the exhaust gases passing from the furnace through the plurality of cyclone separators to render the system more efficient and to reduce the size of the components.

9 Claims, 1 Drawing Figure

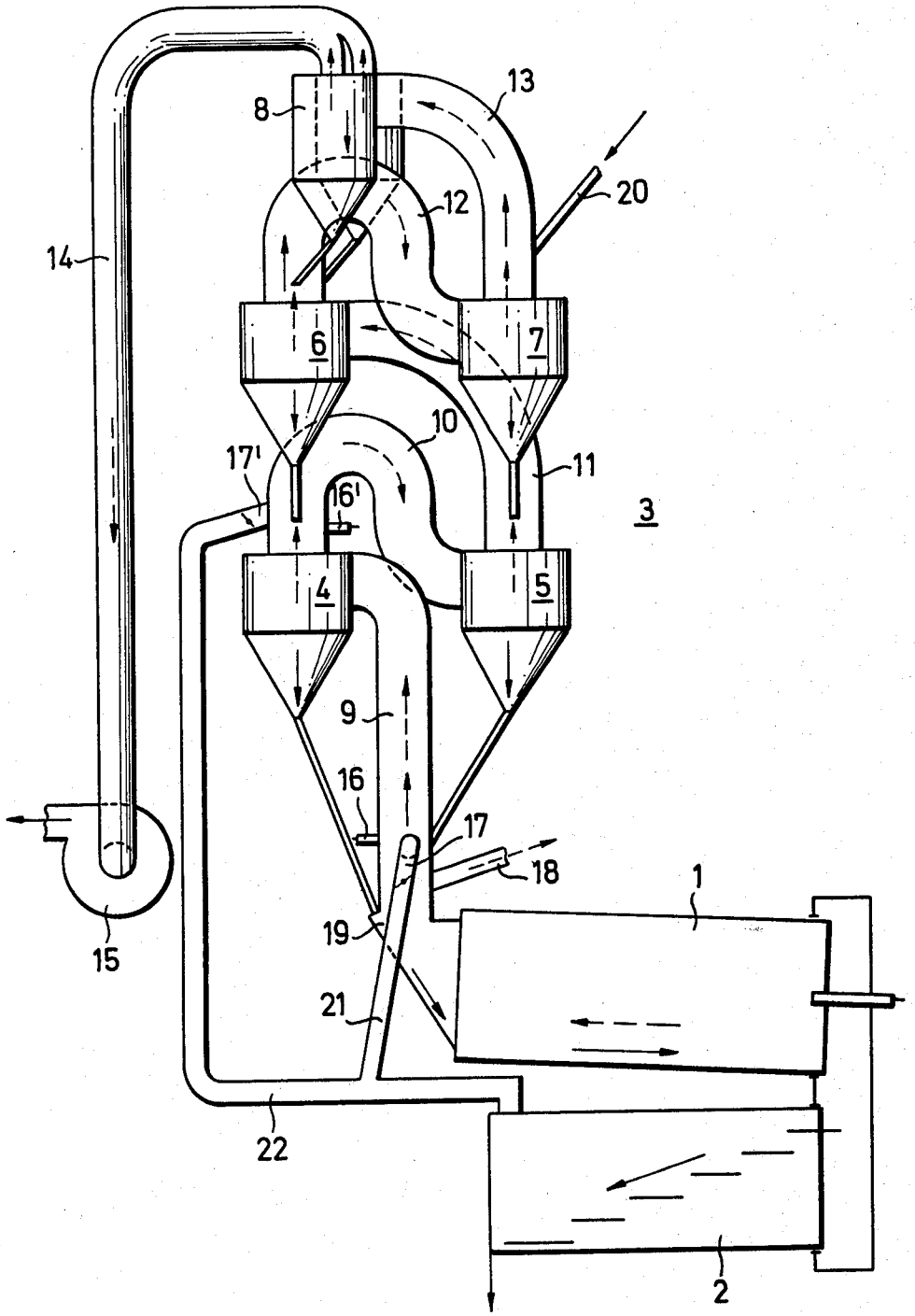
8
13
20
12
14
6
7
10
17'
11
16'
3
4
5
9
16
17
18
1
19
15
21
22
2

APPARATUS AND METHOD FOR THE THERMAL TREATMENT OF FINE GRAINED MATERIAL

BACKGROUND OF THE INVENTION

1. Field of the Invention

This invention is in the field of heat treatment of fine grained particles such as in the calcination of particles in the manufacture of cement and is directed to a system employing serially connected cyclone separators as the heat exchange means, and supplemental combustion means positioned in the path of travel of the particles through the heat exchange means.

2. Description of the Prior Art

The treatment of fine grained material in a calcination furnace, utilizing exhaust gases from the furnace for the preheating and deacidification of pulverized raw material used in the manufacture of cement is a highly developed art. Typically, such installations include several cyclone separators connected in series and joined by means of conduits. The great majority of such installations are characterized by cyclone separators through which the treatment gas flowed, the cyclone separators being arranged with relatively large spacing in order to make possible the flow through of the fine grained material by the force of gravity. It is also thought necessary to use such substantial spacings to obtain sufficiently long burn-out stretches particularly in the conduits between the calcination furnace and the hottest step of the heat exchanger. The result of this type of construction manifests itself in a relatively large vertical height as evidenced, for example, by German Patent No. 1,282,232.

In U.S. Pat. No. 3,235,239 there is described a multiple cyclone heat exchanger for a cement manufacturing installation in which the hot treatment gases consecutively flow through cyclone separators from a rotary kiln and from a combustion chamber with additional firing. These cyclone separators are arranged horizontally adjacent one another. This type of arrangement necessarily results in very great spacings between the elements of the heat exchanger. The long gas and material conveying conduits required provide additional investment costs. Furthermore, the long gas conduits lead to high pressure losses in this system, so that the economy of the system is greatly impaired. Moreover, technical difficulties have been experienced in such systems, resulting from high losses in pressure in the long gas conduits, and caking deposits of materials on the conduit walls.

SUMMARY OF THE INVENTION

The present invention provides a highly effective heat exchanger device without diminishing the number of cyclone steps while decreasing significantly both the structural height and the structural depth of such a multiple cyclone heat exchanger installation. By providing an additional firing in the heat exchanger, I am able to remove some of the load from the calcination furnace sufficiently so that it is possible to use calcination furnaces or kilns of relatively short length.

One of the features of the present invention resides in providing at least the first two heat exchange cyclones at approximately the same vertical height, the exhaust gases from the calcining furnace being flowed through the two cyclone separators in series. Additional means for combustion, including a fuel supply and an combustion air supply, are included either in the exhaust conduit from the calcining furnace leading to the first cyclone, or in the conduit between the first and second cyclones, or both.

In accordance with the present invention, the additional supplemental firing operating according to the suspension gas principle is effective in preheating and deacidifying the calcium carbonate portions of the pulverized raw material so that the entire system can be made more compact in terms of structural height as well as in terms of structural depth. The heat exchanger has the same thermal effectiveness despite its reduced size, so investment costs are lowered. With the inclusion of the additional combustion in the heat exchanger, a substantial part of the heat necessary for the treatment of the material is transferred out of the calcining kiln into the heat exchanger so that a relatively short rotary kiln can be used. Thus, the entire cement making installation can be rendered relatively compact, and the investment costs made correspondingly low. Consequently, the entire economy of the cement manufacturing process may be improved.

In German Pat. No. 1,250,059, there is described a device for the preheating of pulverized raw material in several cyclones arranged adjacent one another and in steps arranged in superimposed relationship through which the exhaust gases of a rotary kiln pass in sequence. Some of the cyclones have a turbulence chamber associated therewith. In this turbulence chamber, an exhaust gas pipe extends horizontally to a cyclone connected in series on the gas side. In this manner, the duration time of the material in the hot furnace exhaust gas stream is intensified but this does not result in an essential reduction of the structural height of the heat exchanger unit. In addition, there are significant investment costs arising from the provision of the turbulence chamber and there is no provision for an additional firing or separate thermal treatment of the material in the heat exchanger system.

In a preferred form of the present invention, the gas conduit which connects the first cyclone to the second cyclone of approximately the same height is formed with an arcuate section so that it receives the gases from the first cyclone in a substantially vertical direction and then directs the gases downwardly and approximately horizontally into the second cyclone. It is possible by means of this feature to increase the treatment time of the material passing from the first to the second cyclone without adding to the structural height of the heat exchanger.

In a further refinement of the present invention, there is provided an air conduit connected to the material cooler which receives the calcined material from the calcining furnace. Preheated combustion air derived from the hottest point of the material cooler may then be passed into the rotary kiln exhaust conduit feeding the first cyclone separator or the conduit connecting the first and second cyclones.

Another feature of the present invention resides in providing a device for partial gas withdrawal in the calcining furnace exhaust gas conduit. This improvement is an advantage where strong alkali-containing raw materials are used from which the alkalies volatilize quantitatively in the sintering step of the calcination furnace and are carried back by the combustion gases into the heat exchanger system. By providing the partial gas withdrawal of the alkali enriched furnace exhaust gases, a material burnt to completion can be attained with a low alkali content.

BRIEF DESCRIPTION OF THE DRAWINGS

The single FIGURE of the drawing illustrates rather schematically a system for the treatment of fine grained particles according to the present invention.

DESCRIPTION OF THE PREFERRED EMBODIMENTS

In the single FIGURE, a cyclone heat exchanger is generally indicated at reference numerals 3 in the drawing. The heat exchanger is connected in series with a rotary kiln 1 serving as a calcining furnace and a material cooler 2. The heat exchanger includes a pair of cyclones 4 and 5 arranged at approximately the same height over which there is superimposed a further pair of cyclones 6 and 7. A double cyclone 8 forms the closure for the heat exchanger system 3.

The first cyclone 4 of the lowermost pair of cyclones is in connection with the rotary kiln 1 by means of an exhaust gas conduit 9. The pair of cyclones 4 and 5 are connected with one another through a gas conduit 10 which has an arcuate configuration such that it receives the hot gases from the cyclone separator 4 in a vertical direction and then directs them in a substantially horizontal direction into the cyclone separator 5. From the cyclone 5 there is a gas conduit 11 leading to the first cyclone 6 of the superimposed upper pair of cyclone separators which likewise are arranged adjacent one another at substantially the same vertical height. These two cyclones are in connection with one another through an arcuately shaped, partially downwardly extending gas conduit 12. The last cyclone 7 of the upper pair of cyclones is connected through a further gas conduit 13 with the double cyclone 8 from which an exhaust gas conduit 14 is directed to an exhaust gas blower 15.

In the furnace exhaust gas conduit 9 there is provided a device 16 for the supply of fuel and a device 17 for the supply of hot cooler exhaust air which functions as combustion air. In addition, the furnace exhaust gas conduit 9 has in the area of the furnace inlet head a device 18 for partial gas withdrawal. The connecting conduit 10 between the lowermost pair of cyclones 4 and 5 is also provided shortly beyond the outlet from the first cyclone 4 on the gas side with a separate fuel supply 16' and a device 17' for supplying hot cooler exhaust air for combustion. A raw material supply conduit 20 for the material to be treated is included in the gas conduit 13 extending between the double cyclone 8 and the upper pair of cyclones 6 and 7.

In operation, the exhaust gases of the rotary kiln 1 flow serially through the cyclone separators 4 through 8 of the heat exchanger 3 by means of the connecting conduits 10 to 13, and are finally drawn through the exhaust gas conduit 14 by means of the blower 15. The fine grained material supplied to the heat exchanger 3 at conduit 20 is in each instance actuated by the gas and thereafter separated in the next separator from the gas, passing through each step in sequence. The heat exchanger as a whole, however, operates in countercurrent contact. The fine grained material treated to completion is finally supplied from the heat exchanger to the inlet chamber 19 of the rotary kiln 1, where the material is sintered in a sintering zone in the rotary kiln 1 and is subsequently removed as cooled sintered material from the cooler 2. To accomplish more intensive material and/or heat exchange, the fuel supply device 16' and the air supply device 17' introduce fuel and air respectively into the connecting conduit 10 of the lower pair of cyclones 4 and 5 so that in this connecting conduit there is an intensive thermal treatment of the material. The particulate material is separated off in the cyclone 5 and is then introduced into the furnace gas exhaust conduit 9. There, the material is subjected in a second processing step to a further heat treatment by means of the fuel supply device 16 and an air supply device 17. The material treated to completion in the heat exchanger is separated from the cyclone 4 of the lowermost pair of cyclones and conveyed through the furnace inlet chamber 19 to the rotary kiln 1 for sintering and thereafter to the cooler 2 for cooling.

The manner of construction provided according to the present invention, with two-step separate combustion lines makes it possible to construct a five-step system with approximately the same structural height as normally occupied by a three-step system. In addition, through the integration of a two-stepped separate calcination or combustion line in the heat exchanger, the rotary kiln is appreciably relieved of its heating load so that only the sintering of the material needs to be carried out in the rotary furnace, making it possible to use a relatively short furnace.

The advantages of this installation are not limited solely to the embodiment shown by way of example in the drawing, but also can be achieved with cyclone heat exchangers of other types of construction.

It should be evident that various modifications can be made to the described embodiments without departing from the scope of the present invention.

I claim as my invention:

1. A system for the treatment of fine grained materials comprising:

a rotary kiln, a plurality of cyclone separators arranged in series, exhaust means delivering exhaust gases from said rotary kiln to one of said cyclone separators, discharge means in said one cyclone separator delivering heat treated solids from said cyclone separator to said rotary kiln, at least the first two of said plurality of cyclone separators being at substantially the same vertical height, conduit means interconnecting said first two cyclone separators, and supplemental combustion means consisting of means for injecting fuel and means for injecting combustion air located in the path of said exhaust gases passing from said kiln through said plurality of cyclone separators.

2. A system according to claim 1 in which said supplemental combustion means is located in said conduit means interconnecting said first two cyclone separators.

3. A system according to claim 1 in which said supplemental combustion means is located between said rotary kiln and the first of said two cyclone separators.

4. A system according to claim 1 in which said plurality of cyclone separators is arranged superimposed in the direction of flow of said exhaust gases.

5. A system according to claim 1 in which said conduit means has an arcuate bend therein and is connected to receive gases substantially vertically from the first of said first two cyclone separators and introduce it substantially horizontally into the second of said first two cyclone separators.

6. A system according to claim 1 which includes:

a cooler receiving the calcined particles from said rotary kiln, and conduit means delivering exhaust gases from said cooler into the exhaust gas conduit between said rotary kiln and the first of said first two cyclone separators.

7. A system according to claim 1 which includes:

a cooler receiving the calcined particles from said rotary kiln, and conduit means delivering exhaust gases from said cooler to said conduit means interconnecting said first two cyclone separators.

8. A system according to claim 1 which includes means for partially withdrawing gases from said exhaust means.

9. A method for the treatment of particles in a rotary kiln and a plurality of cyclone separators which comprises:

passing exhaust gases from said rotary kiln sequentially through said cyclone separators, at least the first two of said cyclone separators being at substantially the same vertical level, passing raw material particles into said cyclone separators in countercurrent contact with the exhaust gases passing therethrough, passing heat treated material from one of said first two cyclone separators into said rotary kiln, and supplying additional combustion heat to said particles as they pass between said first two cyclone separators.

* * * * *